US005855422A

United States Patent [19]

Naef

[11] Patent Number: 5,855,422

[45] Date of Patent: Jan. 5, 1999

[54] BATTERY DISPENSER SYSTEM WITH DETACHABLE DISPENSING UNITS

[76] Inventor: Jon Naef, 12480 Hwy. 59 East, Daphne, Ala. 36526

[21] Appl. No.: 934,807

[22] Filed: Sep. 22, 1997

[51] Int. Cl.[6] ..... A47F 1/08

[52] U.S. Cl. ..... 312/42; 312/45; 211/88.01; 211/59.2

[58] Field of Search ..... 312/35, 42, 45, 312/72, 245; 211/88.01, 94.01, 85.18, 85.5, 14, 59.2; 221/92, 131

[56] References Cited

U.S. PATENT DOCUMENTS

| | | | |
|---|---|---|---|
| 2,119,700 | 6/1938 | Burgess | 312/45 X |
| 2,299,027 | 10/1942 | Novak | 312/45 X |
| 3,193,339 | 7/1965 | Cooper | 312/42 |
| 3,805,964 | 4/1974 | Titus, Jr. . | |
| 4,109,980 | 8/1978 | Brockman et al. | 312/35 |
| 4,146,278 | 3/1979 | Seitel | 312/35 |
| 5,022,537 | 6/1991 | Henriquez | 312/245 X |
| 5,072,997 | 12/1991 | Mayfield, III | 312/35 |
| 5,190,168 | 3/1993 | French et al. | 312/42 X |
| 5,361,937 | 11/1994 | Wiese | 211/59.2 X |

FOREIGN PATENT DOCUMENTS

| | | | |
|---|---|---|---|
| 130379 | 2/1929 | Switzerland | 312/42 |

*Primary Examiner*—Peter M. Cuomo
*Assistant Examiner*—James O. Hansen
*Attorney, Agent, or Firm*—Joseph N. Breaux

[57] ABSTRACT

A battery dispenser system with detachable dispensing units that includes a mounting board having a planar mounting surface, four board mounting apertures formed through the mounting board and at least two sets of dispensing unit snap fastener receiving cavities formed through the planar mounting surface; at least one detachable battery dispensing unit for cylindrical shaped batteries; and at least one detachable battery dispensing unit for rectangular shaped batteries; the battery dispensing unit for rectangular shaped batteries including a planar dispensing ledge, a battery insertion opening, and a feed passageway in connection between the planar dispensing ledge and the battery insertion opening; the battery dispensing unit for cylindrical shaped batteries including a battery feed passageway, a curved forward directing surface partially defining the battery feed passageway, and a battery retaining lip; each detachable battery dispensing unit including a number of dispensing unit snap fasteners that are positionable into one of the at least two sets of dispensing unit snap fastener receiving cavities of the mounting board; each dispensing unit snap fastener including a locking tab portion that engages a projection that partially defines a fastener receiving opening into each dispensing unit snap fastener receiving cavity.

8 Claims, 2 Drawing Sheets

BATTERY DISPENSER SYSTEM WITH DETACHABLE DISPENSING UNITS

TECHNICAL FIELD

The present invention relates to dispenser systems and more particularly to a battery dispenser system that includes a mounting board having a planar mounting surface, four board mounting apertures formed through the mounting board and at least two sets of dispensing unit snap fastener receiving cavities formed through the planar mounting surface; at least one detachable battery dispensing unit for cylindrical shaped batteries; and at least one detachable battery dispensing unit for rectangular shaped batteries; the battery dispensing unit for rectangular shaped batteries including a planar dispensing ledge, a battery insertion opening, and a feed Passageway in connection between the planar dispensing ledge and the battery insertion opening; the battery dispensing unit for cylindrical shaped batteries including a battery feed passageway, a curved forward directing surface partially defining the battery feed passageway, and a battery retaining lip; each detachable battery dispensing unit including a number of dispensing unit snap fasteners that are positionable into one of the at least two sets of dispensing unit snap fastener receiving cavities of the mounting board; each dispensing unit snap fastener including a locking tab portion that engages a projection that partially defines a fastener receiving opening into each dispensing unit snap fastener receiving cavity.

BACKGROUND OF THE INVENTION

Many individuals and businesses use a large number of batteries to power various portable electronic and electrical tools and devices. It would be a benefit, for these organizations and individuals to have a dispenser system for batteries that could be mounted to a wall to maintain the batteries in an organized fashion. In addition, because the type of batteries needed can vary according to the individual or organization, it would be a benefit to have a dispenser system that included a number of detachable battery dispensing units that could be attached by a user to a universal mounting beard. Because most batteries fall within either a cylindrical shape or a rectangular shape, it would also be a benefit to have detachable battery dispensing units that are adapted to store and dispense either rectangular shaped batteries or cylindrical shaped batteries.

SUMMARY OF THE INVENTION

It is thus an object of the invention to provide a battery dispenser system with detachable dispensing units.

It is a further object of the invention to provide a battery dispenser system with detachable dispensing units that can be mounted to a wall to maintain the batteries in an organized fashion.

It is a still further object of the invention to provide a battery dispenser system with detachable dispensing units that are adapted to store and dispense either rectangular shaped batteries or cylindrical shaped batteries.

It is a still further object of the invention to provide a battery dispenser system with detachable dispensing units that includes a mounting board having a planar mounting surface, four board mounting apertures formed through the mounting board and at least two sets of dispensing unit snap fastener receiving cavities formed through the planar mounting surface; at least one detachable battery dispensing unit for cylindrical shaped batteries; and at least one detachable battery dispensing unit for rectangular shaped batteries; the battery dispensing unit for rectangular shaped batteries including a planar dispensing ledge, a battery insertion opening, and a feed passageway in connection between the planar dispensing ledge and the battery insertion opening; the battery dispensing unit for cylindrical shaped batteries including a battery feed passageway, a curved forward directing surface partially defining the battery feed passageway, and a battery retaining lip; each detachable battery dispensing unit including a number of dispensing unit snap fasteners that are positionable into one of the at least two sets of dispensing unit snap fastener receiving cavities of the mounting board; each dispensing unit snap fastener including a locking tab portion that engages a projection that partially defines a fastener receiving opening into each dispensing unit snap fastener receiving cavity.

It is a still further object of the invention to provide a battery dispenser system with detachable dispensing units that accomplish some or all of the above objects in combination.

Accordingly, a battery dispenser system with detachable dispensing units is provided. The battery dispenser system with detachable dispensing units includes a mounting board having a planar mounting surface, four board mounting apertures formed through the mounting board and at least two sets of dispensing unit snap fastener receiving cavities formed through the planar mounting surface; at least one detachable battery dispensing unit for cylindrical shaped batteries; and at least one detachable battery dispensing unit for rectangular shaped batteries; the battery dispensing unit for rectangular shaped batteries including a planar dispensing ledge, a battery insertion opening, and a feed passageway in connection between the planar dispensing ledge and the battery insertion opening; the battery dispensing unit for cylindrical shaped batteries including a battery feed passageway, a curved forward directing surface partially defining the battery feed passageway, and a battery retaining lip; each detachable battery dispensing unit including a number of dispensing unit snap fasteners that are positionable into one of the at least two sets of dispensing unit snap fastener receiving cavities of the mounting board; each dispensing unit snap fastener including a locking tab portion that engages a projection that partially defines a fastener receiving opening into each dispensing unit snap fastener receiving cavity.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
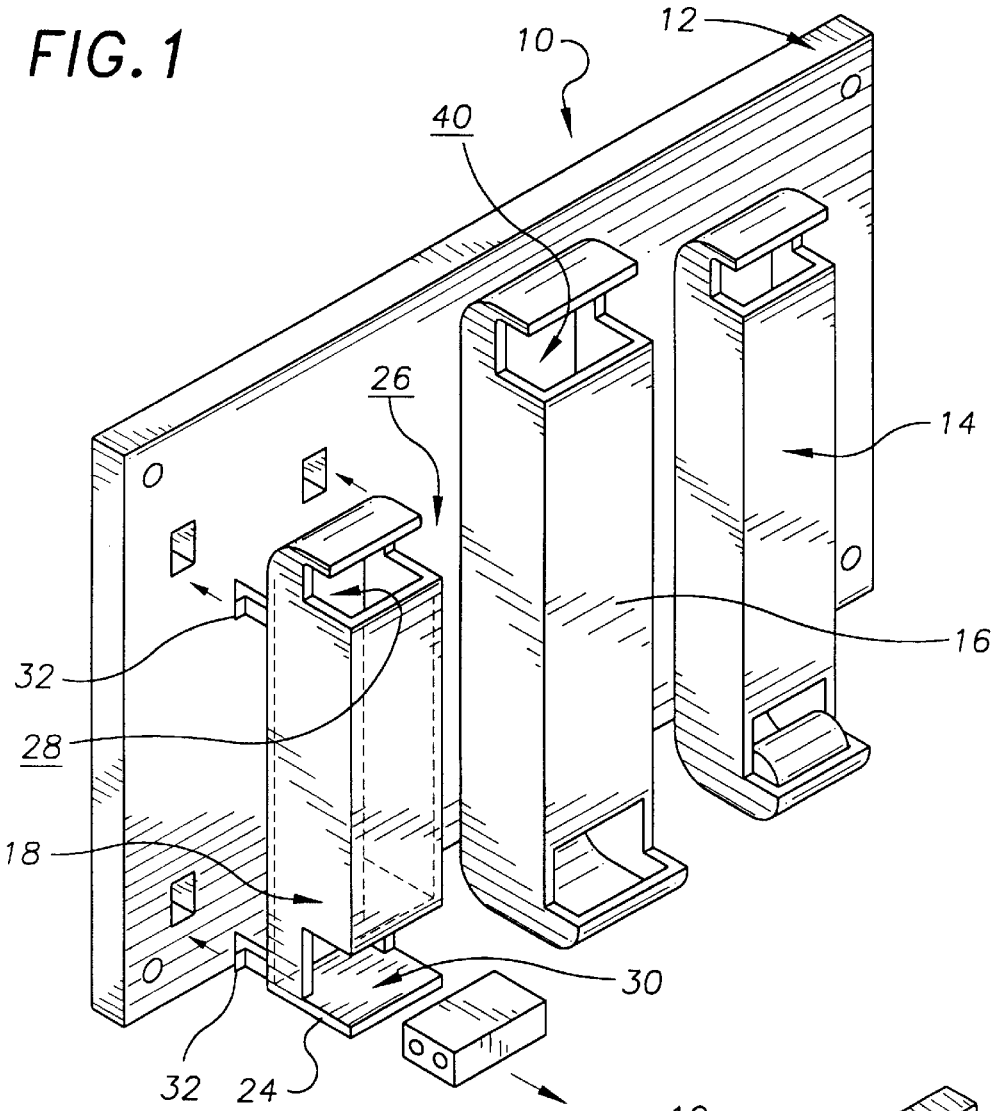
FIG. 1 is a perspective view of an exemplary embodiment of the battery dispenser system of the present invention showing the mounting board; two detachable battery dispensing units for cylindrical shaped batteries; and one detachable battery dispensing unit for rectangular shaped batteries, the battery dispensing unit for rectangular shaped batteries including a planar dispensing ledge, a battery insertion opening, and a feed passageway in connection between the planar dispensing ledge and the battery insertion opening; the battery dispensing unit for rectangular shaped batteries being exploded away from the mounting board to show two of the four snap fasteners provided on each of the three detachable battery dispensing units shown.

FIG. 1 shows an exemplary embodiment of the battery dispenser system of the present invention generally designated by the numeral 10. In this embodiment, dispenser system 10 includes a molded plastic mounting board, generally designated 12; two detachable battery dispensing units for cylindrical shaped batteries, generally designated 14,16; and one detachable battery dispensing unit for rectangular shaped batteries, generally designated 18.

Figure 2:
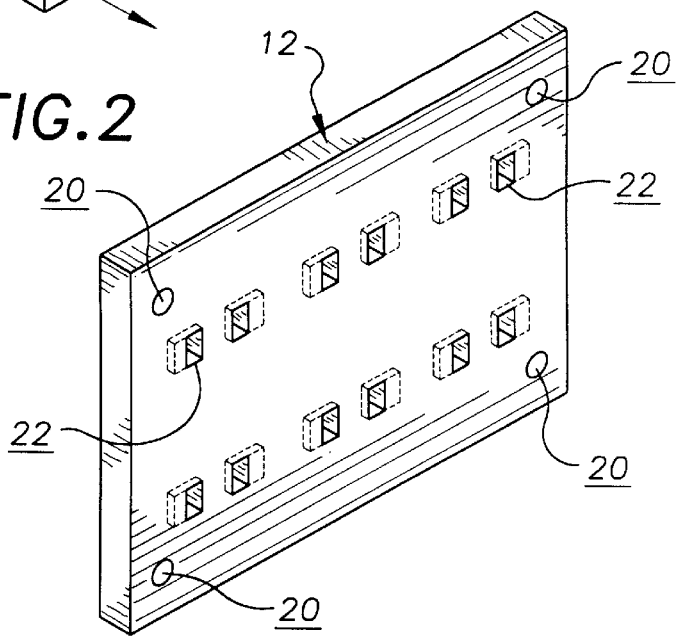
FIG. 2 is a perspective view of the mounting board of FIG. 1 in isolation showing the four board mounting apertures and the three sets of dispensing unit snap fastener receiving cavities.

With reference to FIG. 2, molded plastic mounting board 12 is rectangularly shaped and includes four board mounting apertures 20 and twelve dispensing unit snap fastener receiving cavities 22 arranged into three sets containing four dispensing unit snap fastener receiving cavities 22.

With reference back to FIG. 1, detachable battery dispensing unit for rectangular shaped batteries 18 is molded of transparent plastic and includes a planar dispensing ledge 24, a battery insertion opening 26, a feed passageway 28 in connection between a dispensing opening 30 positioned above planar dispensing ledge 24 and battery insertion opening 26; and four snap fasteners 32 (only two shown).

Figure 3:
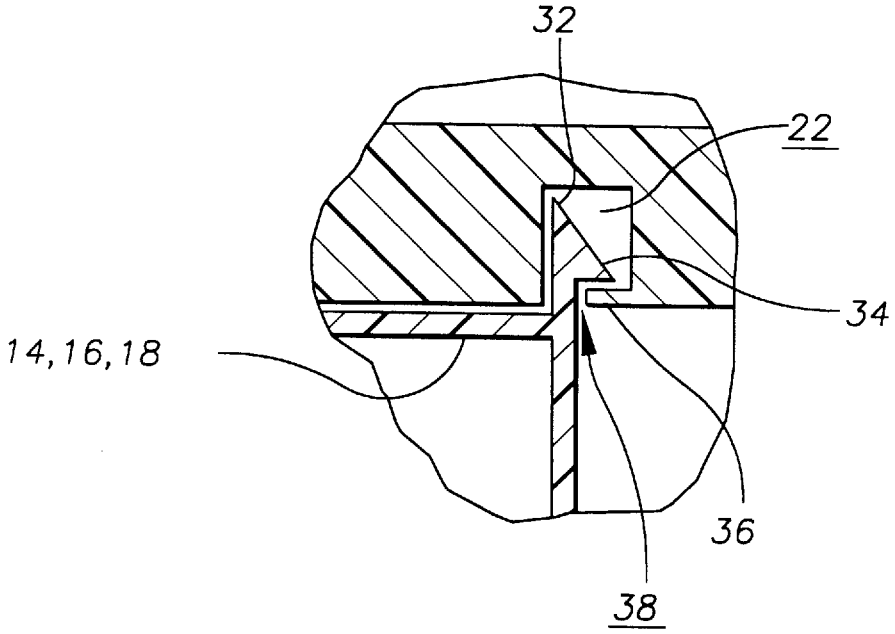
FIG. 3 is a detail cross sectional view showing a dispensing unit snap fastener with a locking tab portion snap fit into one of the dispensing unit snap fastener receiving cavities of the mounting board.

With reference to FIG. 3, each snap fastener 32 is lockable within a dispensing unit snap fastener receiving cavities 22. Each dispensing unit snap fastener 32 includes a locking tab portion 34 that engages a projection 36 that partially defines a fastener receiving opening 38 into each dispensing unit snap fastener receiving cavity 32.

Figure 4:
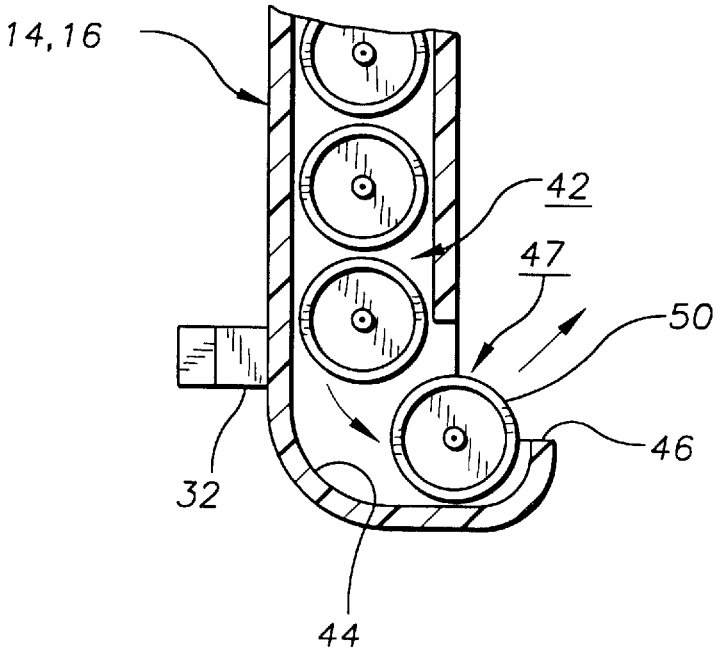
FIG. 4 is a cross sectional view of a detachable battery dispensing unit for cylindrical shaped batteries showing a number of representative cylindrical shaped batteries positioned within the battery feed passageway, the curved torward directing surface partially defining the battery feed passageway, and one of the representative cylindrical shaped batteries positioned within the dispensing opening and held in position by the battery retaining lip.

With reference back to FIG. 1, each battery dispensing unit for cylindrical shaped batteries 14,16 is molded of transparent plastic and includes a battery insertion opening 4C, (with reference now to FIG. 4), a battery feed passageway 42, a curved forward directing surface 44 partially defining battery feed passageway 42, a battery retaining lip 46; a dispensing opening 47 and four snap fasteners 32. In use, retaining lip 46 prevents the bottom cylindrical shaped battery 50 from rolling out of dispensing opening 47.

It can be seen from the preceding description that a battery dispenser system with detachable dispensing units has been provided that can be mounted to a wall so maintain the batteries in an organized fashion; that has detachable dispensing units are adapted to store and dispense either rectangular shaped batteries or cylinidrical shaped batteries; and that includes a mounting board having a planar mounting surface, four board mounting apertures formed through the mounting board and at least two sets of dispensing unit snap fastener receiving cavities formed through the planar mounting surface; at least one detachable battery dispensing unit for cylindrical shaped batteries; and at least one detachable battery dispensing unit for rectangular shaped batteries; the battery dispensing unit for rectangular shaped batteries including a planar dispensing Ledge, a battery insertion opening, and a feed passageway in connection between the planar dispensing ledge and the battery insertion opening; the battery dispensing unit for cylindrical shaped batteries including a battery feed passageway, a curved forward directing surface partially defining the battery feed passageway, and a battery retaining lip; each detachable battery dispensing unit including a number of dispensing unit snap fasteners that are positionable into one of the at least two sets of dispensing unit snap fastener receiving cavities of the mounting board; each dispensing unit snap fastener including a locking tab portion that engages a projection that partially defines a fastener receiving opening into each dispensing unit snap fastener receiving cavity.

It is noted that the embodiment of the battery dispenser system with detachable dispensing units described herein in detail for exemplary purposes is of course subject to many different variations in structure, design, application and methodology. Because many varying arid different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A battery dispenser system with detachable dispensing units comprising:

a mounting board having a planar mounting surface and at least two sets of dispensing unit snap fastener receiving cavities formed through said planar mounting surface;

at least one detachable battery dispensing unit for cylindrical shared batteries; and at least one detachable battery dispensing unit for rectangular shaped batteries;

said at least one battery dispensing unit for rectangular shaped batteries including a planar dispensing ledge, a battery insertion opening, and a feed passageway in connection between said planar dispensing ledge and said battery insertion opening;

said at least one battery dispensing unit for cylindrical shaped batteries including a battery feed passageway, a curved forward directing surface partially defining said battery feed passageway, and a battery retaining lip;

each detachable battery dispensing unit including a number of dispensing unit snap fasteners that are positionable into one of said at least two sets of dispensing unit snap fastener receiving cavities of said mounting board;

each said dispensing unit snap fastener including a locking tab portion that engages a projection that partially defines a fastener receiving opening into each dispensing unit snap fastener receiving cavity.

2. The battery dispenser system with detachable dispensing units of claim 1, wherein:

said mounting board includes four board mounting apertures formed through said mounting board.

3. The battery dispenser system with detachable dispensing units of claim 2, wherein:

said at least one detachable battery dispensing unit for cylindrical shaped batteries is molded from a transparent plastic.

4. The battery dispenser system with detachable dispensing units of claim 3 wherein:

said at least one detachable battery dispensing unit for rectangular shaped batteries is molded from a transparent plastic.

5. The battery dispenser system with detachable dispensing units of claim 2 wherein:

said at least one detachable battery dispensing unit for rectangular shaped batteries is molded from a transparent plastic.

6. The battery dispenser system with detachable dispensing units of claim 1, wherein:

said at least one detachable battery dispensing unit for cylindrical shaped batteries is molded from a transparent plastic.

7. The battery dispenser system with detachable dispensing units of claim 6 wherein:

said at least one detachable battery dispensing unit for rectangular shaped batteries is molded from a transparent plastic.

8. The battery dispenser system with detachable dispensing units of claim 1, wherein:

said at least one detachable battery dispensing unit for rectangular shaped batteries is molded from a transparent plastic.

* * * * *